US005939967A

United States Patent [19]

Gallina et al.

[11] Patent Number: 5,939,967

[45] Date of Patent: Aug. 17, 1999

[54] GROUND PLANE ISOLATION OF PLANAR INDUCTORS USING A MAGNETIC DISK

[75] Inventors: Jan S. Gallina, Torrance; Michael Brand, Los Angeles, both of Calif.

[73] Assignee: Raytheon Company, Lexington, Mass.

[21] Appl. No.: 08/975,884

[22] Filed: Nov. 21, 1997

[51] Int. Cl.[6] ..... H01F 5/00; H01F 27/28

[52] U.S. Cl. ..... 336/232; 336/200; 336/223

[58] Field of Search ..... 336/200, 232, 336/223

[56] References Cited

U.S. PATENT DOCUMENTS 5,075,650 12/1991 Okamura et al. ..... 333/177

5,250,923 10/1993 Ushiro et al. ..... 336/83

*Primary Examiner*—Michael L. Gellner

*Assistant Examiner*—Anh Mai

*Attorney, Agent, or Firm*—Leonard A. Alkov; William C. Schubert; Glenn H. Lenzen, Jr.

[57] ABSTRACT

An approach that minimizes ground plane effects affecting planar inductors is disclosed. A magnetic disk is inserted between an inductor and a ground plane to isolate the magnetic field of the inductor and preserve its magnetic characteristics. The present invention isolates the inductor from the ground plane to maintain or improve inductor electrical performance. The magnetic material serves to increase the inductance to its original value (prior to adding the ground plane) with only a slight degradation in Q due to an increase in AC resistance. This approach permits development of higher current, higher power printed networks, components and circuits whose circuit designs have decreased volume, weight, and cost.

12 Claims, 1 Drawing Sheet

GROUND PLANE ISOLATION OF PLANAR INDUCTORS USING A MAGNETIC DISK

GOVERNMENT RIGHTS

The present invention was developed under contract number F33615-95-C-1767 with the United States Air Force. The United States government has certain rights in this invention.

BACKGROUND

The present invention relates generally to inductor isolation, and more particularly, to an inductive arrangement and method for isolating planar inductors using a magnetic disk to minimize ground plane effects.

Typically, characteristics of inductive components are severely degraded when the inductor is in close proximity to another piece of metal, such as ground planes. In particular, the inductance value can decrease by over 65%. This results in a significant decrease in component Q. Consequently, component surface area must increase, thus increasing the overall circuit size. This is detrimental to applications requiring high power densities.

Current approaches mitigate ground plane effects in several ways. One approach is to eliminate the ground plane altogether and replace it with a ground trace. Another approach requires holes or cut-outs in a portion of ground plane located directly above the affected component. However, these two approaches prove to be detrimental to the electrical performance of the circuit. The third approach is to separate the ground plane from the inductor by a relatively large distance, which is over three times the required thickness of the circuit substrate. This is undesirable for low profile, high power density applications where minimizing circuit volume is critical.

Accordingly, it is an objective of the present invention to provide for an inductive arrangement and method for isolating planar inductors that overcomes the limitations of prior art approaches. It is a further objective of the present invention to provide for an inductive arrangement and method for isolating planar inductors using a magnetic disk to minimize ground plane effects.

SUMMARY OF THE INVENTION

To accomplish the above and other objectives, the present invention provides for a novel approach to minimizing ground plane effects on planar inductors. The present invention inserts a magnetic disk between an inductor and a ground plane to isolate the magnetic field of the inductor, thus preserving its magnetic characteristics.

As was stated in the Background section, the beneficial characteristics of inductive components are severely degraded when the inductor is in close proximity to another piece of metal, such as ground planes. The purpose of the present invention is to isolate the inductor from the ground plane in order to maintain or improve inductor electrical performance.

More specifically, the present invention provides a means for retaining a solid ground plane in close proximity to the inductor. This is accomplished by placing magnetic material between the ground plane and the inductor. The magnetic material serves to increase the inductance to its original value (prior to adding a ground plane) with only a slight degradation in Q due to an increase in AC resistance. The approach provided by the present invention permits development of higher current, higher power printed networks, components (e.g., inductors), and circuits (i.e., RF amplifiers and VHF converters). Furthermore, the application of the present invention in circuit designs leads to decreased volume, weight, and cost.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
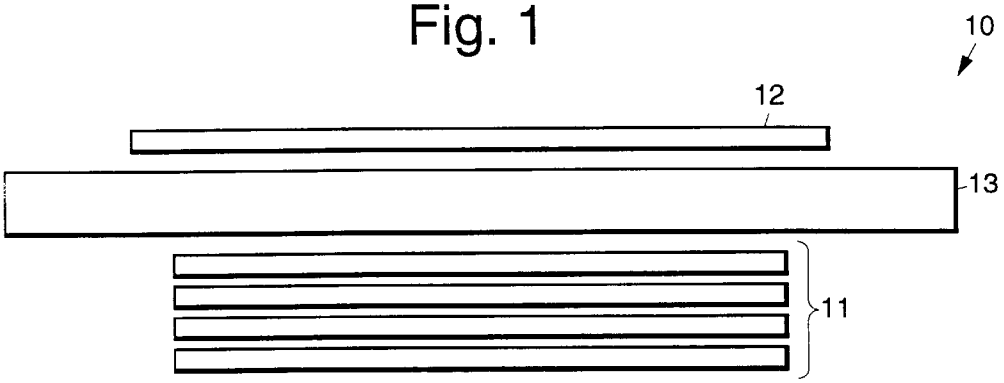
FIG. 1 illustrates a cross-section of an inductive circuit in accordance with the principles of the invention.

With reference to FIG. 1, it illustrates a cross-section of an inductive circuit 10 in accordance with the principles of the present invention. The present inventors have found a unique design approach using magnetic material that minimizes ground plane effects affecting inductors. The inductive circuit 10 comprises a multilayer planar inductor 11 having an adjacent ground plane 12. A magnetic disk 13 in accordance with the principles of the present invention is disposed between the inductor 11 and the ground plane 12.

More specifically, when the ground plane 12 is located in close proximity to the inductor 11, this decreases the magnetic flux density of the inductor 11. This effect causes the inductance value of the inductor 11 to decrease significantly. The decrease in inductance results in a decrease in Q, which severely degrades electrical performance.

With the approach of the present invention, magnetic material 13 in the form of a flat (planar) magnetic disk 13 is inserted between the inductor 11 and the ground plane 12. The size, thickness, shape, and location (spacing) of the magnetic disk 13 are important design considerations which may be optimized to achieve maximum inductance and minimum AC resistance, thus maximizing Q.

The outer dimensions of the magnetic disk 13 must be larger than that of the inductor 11 and ground plane 12, as is illustrated in FIG. 1. The shape of the magnetic disk 13 must be substantially similar to the shape (footprint) of the inductor 11. The thickness of the magnetic disk 13 may vary depending on the space available between the ground plane 12 and the inductor 11. In general, the thicker the magnetic disk 13, the better.

Depending on the application, the distance between the ground plane 12 and the inductor 11 also offers some flexibility with regard to location of the magnetic disk 13. However, there are no specific design rules for spacing between the magnetic disk 13 and the ground plane 12, or between the magnetic disk 13 and the inductor 11. In general, if the disk magnetic disk 13 is moved closer to the ground plane 12, the inductance tends to decrease. On the other hand, if the magnetic disk 13 is moved closer to the inductor 11, inductance tends to increase.

In addition to geometry and location considerations, the magnetic disk 13 must be solid (no gaps). Using the magnetic disk 13, the magnetic field is isolated from the ground plane 12. The magnetic disk 13 serves to increase the magnetic flux density of the inductor 11, thus increasing the inductance value.

The present invention was developed for use in a VHF power supply. Parts implementing the magnetic disk 13 have been fabricated in order to test out the principles of the present invention. For example, 30 MHz test results for a four-turn vertical solenoid inductor 11 are shown in Table 1. The data indicates a decrease of 60% in inductance value, with a corresponding decrease in Q of 60% when a ground plane 12 is placed in close proximity to the inductor 11. By inserting the magnetic disk 13 between the inductor 11 and the ground plane 12, the inductance value increases to approximately its original value. Furthermore, the achieved Q increases to within 25% of its original value.

TABLE 1

| Description | Inductance (nH) | Q |
|---|---|---|
| Inductor | 82.7 | 100.0 |
| Inductor with ground plane | 34.4 | 41.6 |
| Inductor with ground plane magnetic disk | 83.9 | 76.5 |

It should be noted that at the time these parts were fabricated, the size of the magnetic disk 13 was not optimized. Simulation data shows that with a larger diameter magnetic disk 13, the inductance value not only increases to its original value, but exceeds it by over 15%. Simulation data also indicates an increase of Q to within 5% of its original value may be achieved. The present invention thus permits fabrication of lower profile, smaller inductive circuits while maintaining good electrical performance.

Figure 2:
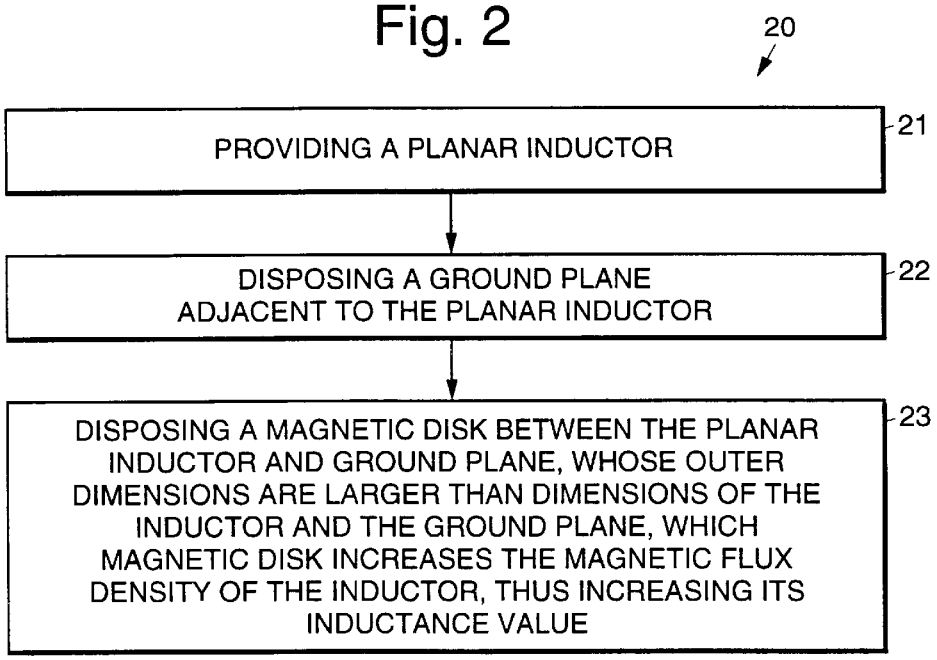
FIG. 2 illustrates an exemplary method in accordance with the principles of the present invention.

The present invention also contemplates a method 20 for isolating planar inductors using a magnetic disk to minimize ground plane effects. One exemplary method 20 in accordance with the principles of the present invention is depicted in the flow chart shown in FIG. 2. The method 20 comprises the following steps.

A planar inductor 11 is provided 21. A ground plane 12 is disposed 22 adjacent to the inductor. Then, a magnetic disk 13 is disposed 23 between the inductor 11 and ground plane 12, whose outer dimensions are larger than dimensions of the inductor and the ground plane, which magnetic disk increases the magnetic flux density of the inductor, thus increasing its inductance value. The magnetic disk 13 disposed between the inductor 11 and ground plane 12 is preferably solid, and is typically flat.

The present invention may be used to produce power RF circuits VHF converters, and the like, and in particular, high current/low voltage converters. Systems that require very high power processing densities will benefit from the present invention. In particular, active arrays will benefit from the reduced size, weight, and cost, which will result from applying this technology to an antenna power supply subsystem, for example. Military applications for this technology include processors and man-portable systems. There are also significant commercial applications in the telecommunications, computer, and automotive markets. Applications for automobiles include power supplies for instrument clusters, radios, and microprocessors, for example.

Thus, an inductive arrangement and method for isolating planar inductors using a magnetic disk to minimize ground plane effects have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An inductive circuit comprising:

a planar inductor;

a ground plane disposed adjacent to the inductor; and a magnetic disk disposed between the inductor and ground plane, whose outer dimensions are larger than dimensions of the inductor and the ground plane, and wherein the magnetic disk increases the magnetic flux density of the inductor, thus increasing its inductance value.

2. The inductive circuit of claim 1 wherein the magnetic disk comprises a planar magnetic disk.

3. The inductive circuit of claim 2 wherein the magnetic disk is solid.

4. The inductive circuit of claim 1 wherein the magnetic disk is solid.

5. An inductive circuit comprising:

a planar inductor;

a flat ground plane disposed adjacent to the inductor; and a flat magnetic disk disposed between the inductor and ground plane, whose outer dimensions are larger than dimensions of the inductor and the ground plane, and wherein the magnetic disk increases the magnetic flux density of the inductor, thus increasing its inductance value.

6. The inductive circuit of claim 5 wherein the magnetic disk is solid.

7. An inductive circuit comprising:

a planar inductor;

a ground plane disposed adjacent to the inductor; and a solid magnetic disk disposed between the inductor and ground plane, whose outer dimensions are larger than dimensions of the inductor and the ground plane, and wherein the magnetic disk increases the magnetic flux density of the inductor, thus increasing its inductance value.

8. The inductive circuit of claim 7 wherein the solid magnetic disk comprises a solid flat magnetic disk.

9. A method of isolating planar inductors to minimize ground plane effects, said method comprising the steps of:

providing a planar inductor;

disposing a ground plane adjacent to the planar inductor; and disposing a magnetic disk between the planar inductor and ground plane, whose outer dimensions are larger than dimensions of the inductor and the ground plane, which magnetic disk increases the magnetic flux density of the inductor, thus increasing its inductance value.

10. The method of claim 9 wherein the step of disposing a magnetic disk between the inductor and ground plane comprises the step of:

disposing a flat magnetic disk between the inductor and ground plane.

11. The method of claim 9 wherein the step of disposing a magnetic disk between the inductor and ground plane comprises the step of:

disposing a solid magnetic disk between the inductor and ground plane.

12. The method of claim 9 wherein the step of disposing a magnetic disk between the inductor and ground plane comprises the step of:

disposing a solid flat magnetic disk between the inductor and ground plane.

* * * * *